US010435930B2

(12) United States Patent
Abele

(10) Patent No.: US 10,435,930 B2
(45) Date of Patent: Oct. 8, 2019

(54) CORNER CABINET

(71) Applicant: Hetal-Werke Franz Hettich GmbH & Co. KG, Alpirsbach (DE)

(72) Inventor: Horst Abele, Aichhalden (DE)

(73) Assignee: HETAL-WERKE FRANZ HETTICH GMBH & CO. KG, Alpirsbach (DE)

( * ) Notice: Subject to any disclaimer, the term of this patent is extended or adjusted under 35 U.S.C. 154(b) by 0 days.

(21) Appl. No.: 15/789,330

(22) Filed: Oct. 20, 2017

(65) Prior Publication Data

US 2018/0119466 A1 May 3, 2018

(30) Foreign Application Priority Data

Oct. 28, 2016 (DE) ..... 20 2016 006 655 U

(51) Int. Cl.

| | |
|---|---|
| ***E05D 3/14*** | (2006.01) |
| ***E05F 5/00*** | (2017.01) |
| ***A47B 77/02*** | (2006.01) |
| ***A47B 81/00*** | (2006.01) |
| ***E06B 3/48*** | (2006.01) |
| ***E05D 15/26*** | (2006.01) |
| *E05D 11/06* | (2006.01) |

(52) U.S. Cl.

CPC ..... *E05D 3/142* (2013.01); *A47B 77/02* (2013.01); *A47B 81/002* (2013.01); *E05D 15/26* (2013.01);

(Continued)

(58) Field of Classification Search

CPC ..... E05D 3/142; E05D 15/26; E05D 15/264; E05D 11/06; E05D 15/56; E05D 15/58; E05D 2015/586; E05D 2011/1092; E05D 11/10; E05D 11/1007; E05D 11/1014; E05D 11/1021; E05D 11/1028; E05D 11/1035; E05D 11/1042; E05D 11/105;

(Continued)

(56) References Cited

U.S. PATENT DOCUMENTS 3,258,302 A 6/1966 Ruisch
3,968,540 A * 7/1976 Lautenschlager ..... E05D 3/142 16/370

(Continued)

FOREIGN PATENT DOCUMENTS

CN 2829473 Y 10/2006
CN 103767348 A 5/2014

(Continued)

OTHER PUBLICATIONS

Chinese Search Report Application No. 201711022365.4.

*Primary Examiner* — Hiwot E Tefera
(74) *Attorney, Agent, or Firm* — Hoffmann and Baron, LLP

(57) ABSTRACT

A corner cabinet includes a cabinet carcass with a door opening and a corner cabinet door which is mounted on the cabinet carcass so as to swivel between a closed position in which the door opening is closed and an open position allowing access to an interior space of the cabinet carcass. The corner cabinet door is designed as a folding door with two door elements. In the closed position, outer sides of the two door elements pointing away from the interior space enclose an external angle α which can be changed when opening the corner cabinet door. A swivel angle limiting device acting between the two door elements is provided through which the swiveling range of the two door elements relative to one another is limited to a maximum external angle α.

3 Claims, 9 Drawing Sheets

(52) U.S. Cl.
CPC ..... *E05D 15/264* (2013.01); *E05F 5/006* (2013.01); *E06B 3/482* (2013.01); *E05D 11/06* (2013.01); *E05Y 2600/46* (2013.01); *E05Y 2900/20* (2013.01)

(58) Field of Classification Search
CPC ..... E05D 11/1057; E05D 11/1064; E05D 11/1071; E05D 11/1078; E05D 11/1085; E06B 3/482; E05F 5/006; E05F 5/12; A47B 77/02; A47B 81/002; A47B 49/006; E05Y 2800/11; E05Y 2600/46; E05Y 2900/20
USPC ..... 16/374, 375, 376, 377
See application file for complete search history.

(56) References Cited

U.S. PATENT DOCUMENTS 4,819,298 A * 4/1989 Lautenschlager ..... E05D 11/06 16/237
4,998,941 A * 3/1991 Smith ..... E05D 11/06 16/374
5,201,096 A 4/1993 Dubach et al.
5,465,463 A * 11/1995 Lautenschlager ..... E05D 7/0407 16/236
5,500,983 A 3/1996 Lautenschlager
5,765,262 A 6/1998 Salice
2006/0090295 A1* 5/2006 Hofer ..... E05D 5/065 16/237
2014/0224435 A1 8/2014 Stawski
2017/0022744 A1* 1/2017 Migli ..... E05F 5/006
2018/0119468 A1* 5/2018 Abele ..... E05F 1/12

FOREIGN PATENT DOCUMENTS

CN 203814939 U 9/2014
CN 204635515 U 9/2015
CN 205053321 U 3/2016
CN 205493159 U 8/2016
EP 0468176 A1 1/1992
WO WO2008024469 A2 2/2008

* cited by examiner

CORNER CABINET

BACKGROUND OF THE INVENTION

The invention relates to a corner cabinet, in particular a kitchen corner cabinet, comprising a cabinet carcass with a door opening and a corner cabinet door which is mounted on the cabinet carcass so as to swivel between a closed position in which the door opening is closed and an open position allowing access to an interior space of the cabinet carcass, wherein the corner cabinet door is designed as a folding door, with a first door element which is mounted on the cabinet carcass in the vicinity of the door opening by means of a door bearing device, and with a second door element which is mounted swivelably on the first door element via swivel bearing means, wherein in the closed position outer sides of the two door elements pointing away from the interior space enclose an external angle α which in the closed position lies within the range from 45° to 180° and can be changed when opening the corner cabinet door.

Such corner cabinets have long been known. The most common corner cabinets of this type possess a door opening which extends at an angle of 90°, so that in the closed position the two door elements enclose an external angle which amounts to 90°. However, there are also corner cabinet solutions in which the door elements assume an angle other than 90° in the closed position, for example an acute or obtuse angle.

When opening the folding door, as a rule the external angle which the two door elements have assumed relative to one another in the closed position changes. Since, as a rule, in order to open the door the user grasps the second door element and pulls this towards them, as a rule the external angle increases when opening the folding door from the angle position assumed in the closed position, for example 90°. If the folding door is then closed again, then as a rule the user again grasps the second, outer door element. However, when swiveling the folding door into the closed position there is a risk that the second, outer door element may strike a cabinet door of an adjacent cabinet or cabinet part and damage the handle thereof or even the front of the cabinet door, if the external angle between the two door elements when swiveling in is greater than the external angle which the two door elements assume relative to one another in the closed position.

Particularly if, when closing, the two door elements assume an external angle relative to one another which is very large, for example greater than 150°, or even assume a flush alignment relative to one another with the external angle of 180°, there is a risk that improper operation may lead to such damage to the adjacent cabinets or cabinet components.

SUMMARY OF THE INVENTION

The object of the invention is therefore to create a corner cabinet of the aforementioned type in which the risk of damage to cabinets or cabinet components adjacent to the corner cabinet is reduced in comparison with corner cabinets known from the prior art.

This object is achieved by means of a corner cabinet with the features disclosed herein.

The corner cabinet according to the invention is characterized in that a swivel angle limiting device acting between the two door elements is provided through which the swiveling range of the two door elements relative to one another is limited to a maximum external angle α which lies within the range from 45° to 180°.

Through the swivel angle limiting device, the maximum external angle is limited to a range between 45° and 180°, as a result of which a free swiveling of the second door element, via the swivel bearing means, around the first door element beyond this range is not possible. Expediently, the value of the maximum external angle α which has been or is to be adjusted is dependent on the external angle α which the two door elements assume relative to one another in the closed position. Expediently, the maximum external angle is different from the external angle which the two door elements assume relative to one another in the closed position. With an external angle α of 90° in the closed position of the two door elements, it is not necessary to limit the maximum external angle to 90°; rather, it can be limited to an angle above 90°. The important thing is that it is apparent to the user that the swiveling range of the two door elements relative to one another is limited. Thus, should the user close the folding door by handling the second door element, then the free moveability of the second door element is limited, as a result of which the user is given a signal to close the folding door properly, as a result of which the risk of damage to adjacent cabinets or cabinet components is reduced.

In a further development of the invention, the maximum external angle lies within the range from 70° to 170°. Particularly preferably, the maximum external angle α lies within the range from 110° to 140°, in particular 115° to 135°.

In a particularly preferred manner, the maximum external angle α lies within the range from 120° to 130°, in particular it amounts to approx. 125°. Particularly in the case that, in the closed position, the two door elements assume an external angle α of 90°, it is of advantage to limit the maximum external angle within the range from 120° to 130°, in particular to approx. 125°.

In a further development of the invention, the swivel angle limiting device has an adjustment device allowing adjustment of the maximum external angle α. This makes it possible to adjust the maximum external angle α to a desired value within the range from 45° to 180°. Alternatively, it is possible for the maximum external angle α to be fixed by the swivel angle limiting device without the possibility of adjustment.

In a further development of the invention, the swivel angle limiting device is associated with the swivel bearing means.

In a particularly preferred manner, the swivel bearing means comprise at least one hinge connecting the two door elements swivelably with one another, having a first hinge part fixed on the first door element and a second hinge part fixed on the second door element which are connected with one another in an articulated manner via at least one articulated joint. In this case the swivel angle limiting device is thus associated with the hinge.

It is possible that the swivel angle limiting device has a stop surface formed on the first or second hinge part for a corresponding stop formed on the second and first hinge part which impinges on the associated stop surface on swiveling of the two door elements.

In a particularly preferred manner, the stop forms part of the adjustment device. For example, the stop is in the form of an adjustment element formed, adjustably, on one of the two hinge parts, for example in the form of an adjustment screw, such that the adjustment element impinges on the stop surface sooner or later during swiveling of the two door elements, depending on the adjustment position.

In a further development of the invention, the two hinge parts are designed in the form of a hinge cup and hinge arm, wherein the hinge cup is preferably attached to the first door element and the hinge arm is attached to the second door element. Alternatively, it would of course also be conceivable to attach the hinge cup to the second door element and the hinge arm to the first door element.

In a particularly preferred manner, the hinge arm has a fixing section attached to an inner side of the second door element and an arm section bridging a joint between the two door elements and pointing in the direction of the hinge cup which projects at an angle from the fixing section in the direction of the outer surfaces of the door elements, wherein the stop is arranged on the free end of the arm section.

Particularly preferably, the hinge cup has a cup section which is fitted in a cup-like recess in the inner side of the first door element, wherein the cup section has a cup opening bounded by a cup wall on which the stop surface for the stop is formed. Expediently, the stop surface is aligned obliquely.

In a further development of the invention, the swivel angle limiting device is formed separate from the swivel bearing means. It is also possible for the swivel angle limiting device both to be associated with the swivel bearing means and also formed separate from the swivel bearing means. In the latter case, components of the swivel angle limiting device are located on the swivel bearing means and other components of the swivel angle limiting device are formed separate from the swivel bearing means.

It is possible for the swivel angle limiting device to have at least one angle piece which has a mounting section by means of which it is fixed to one of the two door elements, in particular to the first door element, and a stop section for the other door element which projects at an angle from the mounting section in the direction of the other door element, bridging the joint between the two door elements.

It is possible for the angle piece to be arranged preferably centrally in the height direction of the door element, in particular, where there are two hinges connecting the door elements swivelably with one another, being arranged between the two hinges.

Fundamentally, it is possible to arrange the angle piece at any point in the height direction of the door elements not occupied by the swivel bearing means, in particular hinges, also for example below the lower hinge or above the upper hinge. A non-central arrangement between the two hinges is also possible.

In order to prevent the second door element coming to a hard stop against the swivel angle limiting device if swivelled rapidly, this can be equipped with a damping device for damping the swivel movement of the second door element. This prevents a hard stop on reaching the maximum external angle $\alpha$.

In a further development of the invention, a control device for controlling the movement of the corner cabinet door is provided, with a base part which can be fixed onto the cabinet carcass and a control part which is mounted on the base part so as to be moveable between an inner position and an outer position in which it projects beyond the plane of a door opening, wherein the control part can be coupled with the second door element when closing and uncoupled when opening by means of coupling means, such that it controls the movement of the second door element at the end of the closing phase and at the beginning of the opening phase. Because the control part projects beyond the plane of the door opening when the corner cabinet door is open, the second door element first impinges on the control part when closing and as a result is held at a distance from a cabinet carcass adjacent to the corner cabinet. In combination with the swivel angle limiting device, this ensures that it is practically impossible for the second door element to strike an adjacent cabinet or an adjacent cabinet part, so preventing damage to the handle or to the front of the adjacent cabinet or cabinet part.

BRIEF DESCRIPTION OF THE DRAWINGS

Preferred exemplary embodiments of the invention are illustrated in the drawing and explained in more detail in the following, wherein.

DETAILED DESCRIPTION

FIGS. 1 to 10 show a first exemplary embodiment of the corner cabinet 11 according to the invention.

Figure 5:
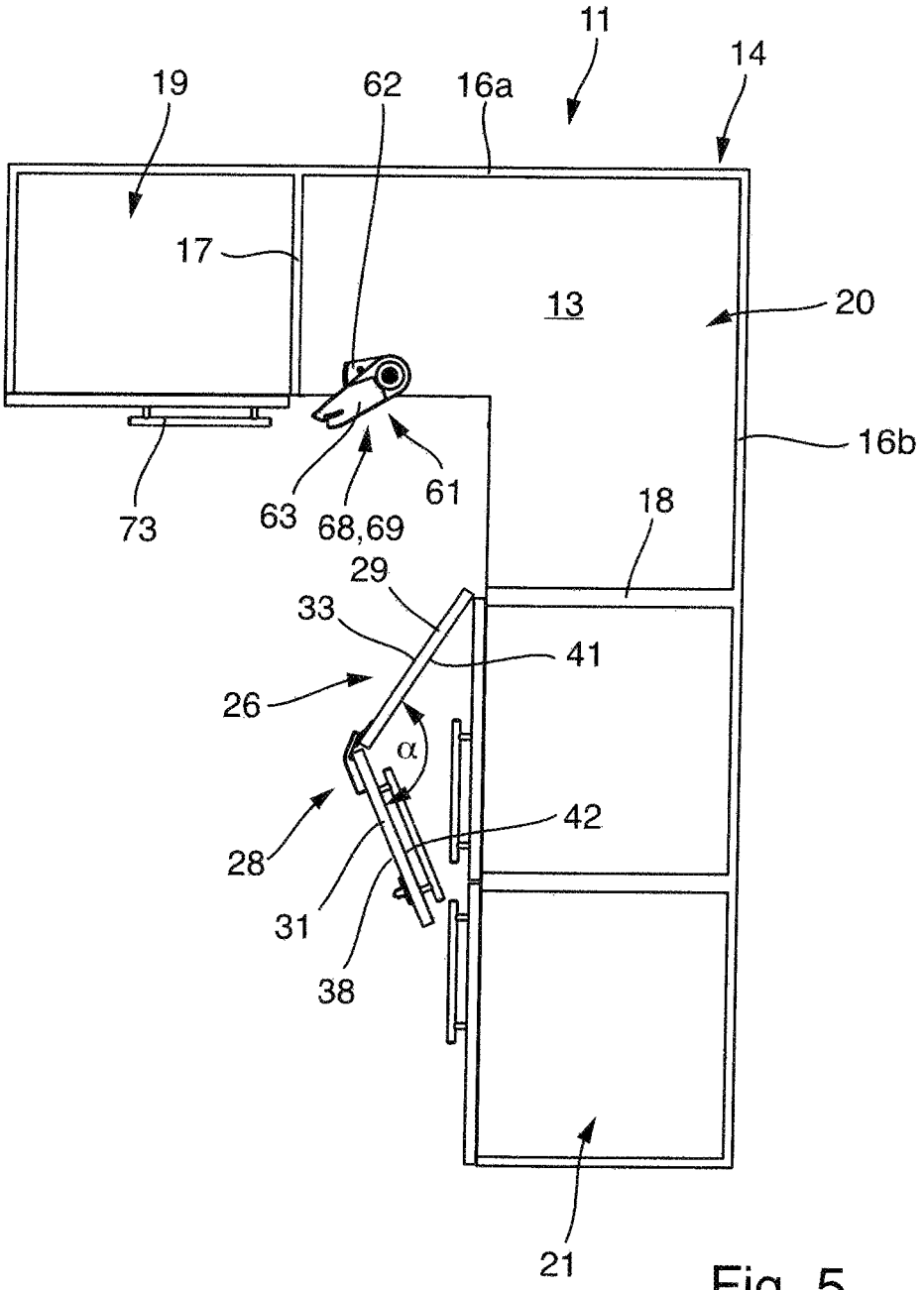
FIG. 5 shows a top view of the corner cabinet from FIG. 3.
Figure 6:
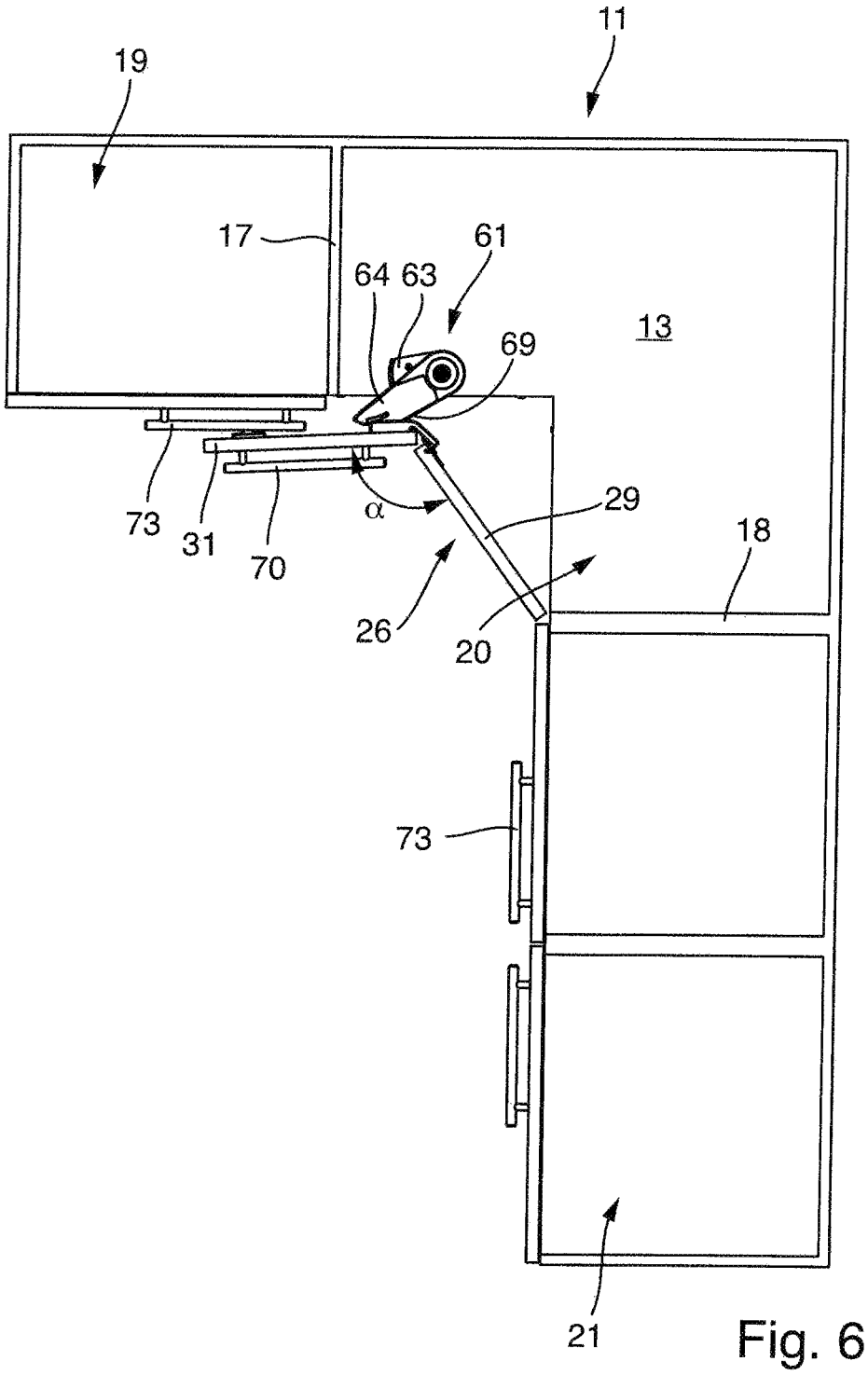
FIG. 6 shows a top view of the corner cabinet from FIG. 3, wherein the corner cabinet door is swivelled in the closing direction.
Figure 7:
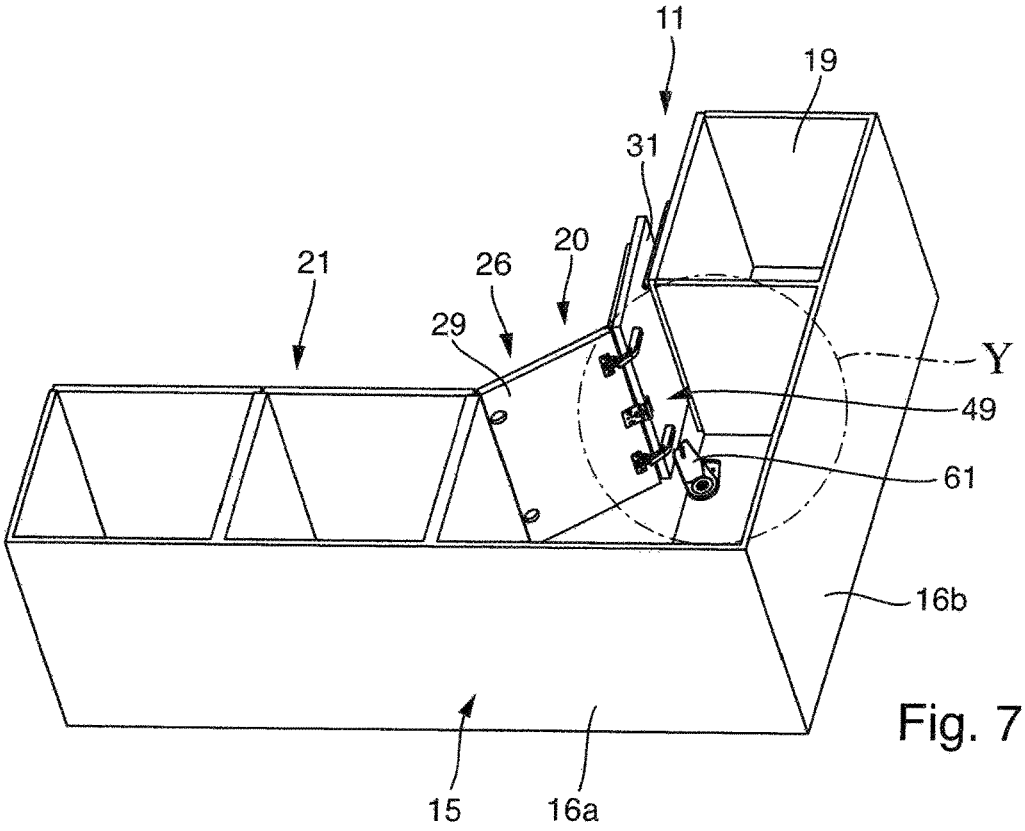
FIG. 7 shows a perspective representation of the corner cabinet from FIG. 6 in the direction of the rear sides of the door elements.

As shown in FIG. 6 in particular, the corner cabinet 11 has a cabinet carcass 12, which by way of example is shown with an L-shaped floor outline. The cabinet carcass 12 consists of a cabinet base 13, which by way of example is shown with an with L-shaped floor outline. As a rule, supporting feet are arranged on the underside of the cabinet base 13 which are if necessary height-adjustable in order to guarantee that the corner cabinet 11 stands without any play, even on an uneven floor surface. The intervening space between the underside of the cabinet base 13 and the floor surface within which the supporting feet are arranged is clad with a baseboard 14. The cabinet carcass 13 also possesses a rear wall 15 which for example consists of two rear wall parts 16*a*, 16*b* arranged at right angles relative to one another. As shown in FIG. 5 in particular, the two rear wall parts 16*a*, 16*b* preferably adjoin side walls 17, 18 arranged at right angles thereto.

At the same time the side walls 17, 18 form side walls for left-hand and right-hand extensions of the cabinet carcass 12. In the example shown, a carcass component 19 with rectangular floor outline adjoins the carcass component of the cabinet carcass 12 with L-shaped floor outline on the left-hand side. The left-hand side wall 17 of the L-shaped carcass component thereby simultaneously forms the right-hand side wall of the further carcass component 19. A further carcass component 21 also adjoins the right-hand side wall 18 of the inner L-shaped carcass component 20 of the corner cabinet 11, so that the right-hand side wall 18 forms the left-hand side wall of the further carcass component 21.

In the example shown, the right-hand further carcass component 21 is twice as large as the left-hand further carcass component 19. Naturally it is also possible for the dimensions of the further carcass components 19, 21 to be quite different, for example the left-hand carcass component could be larger than the right-hand one. It is also possible that the inner carcass component 20 with L-shaped floor outline forms the complete corner cabinet 11 and in this case further separate cabinets adjoin it on the left-hand and right-hand sides.

Figure 1:
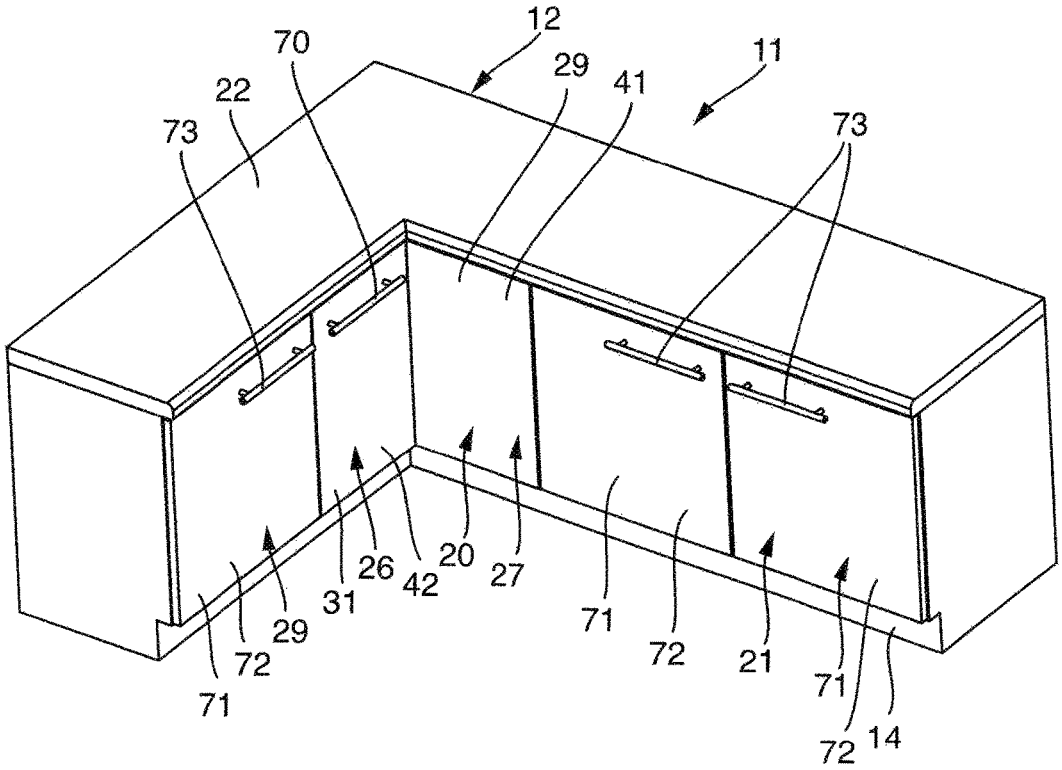
FIG. 1 shows a perspective representation of a first exemplary embodiment of the corner cabinet according to the invention.

The corner cabinet 11 also possesses an upper cabinet covering which by way of example is shown in the form of a work surface 22. As shown in FIG. 1 in particular, the work surface 22 is also L-shaped in form and extends over all the carcass components 19-21 of the corner cabinet 11.

Figure 2:
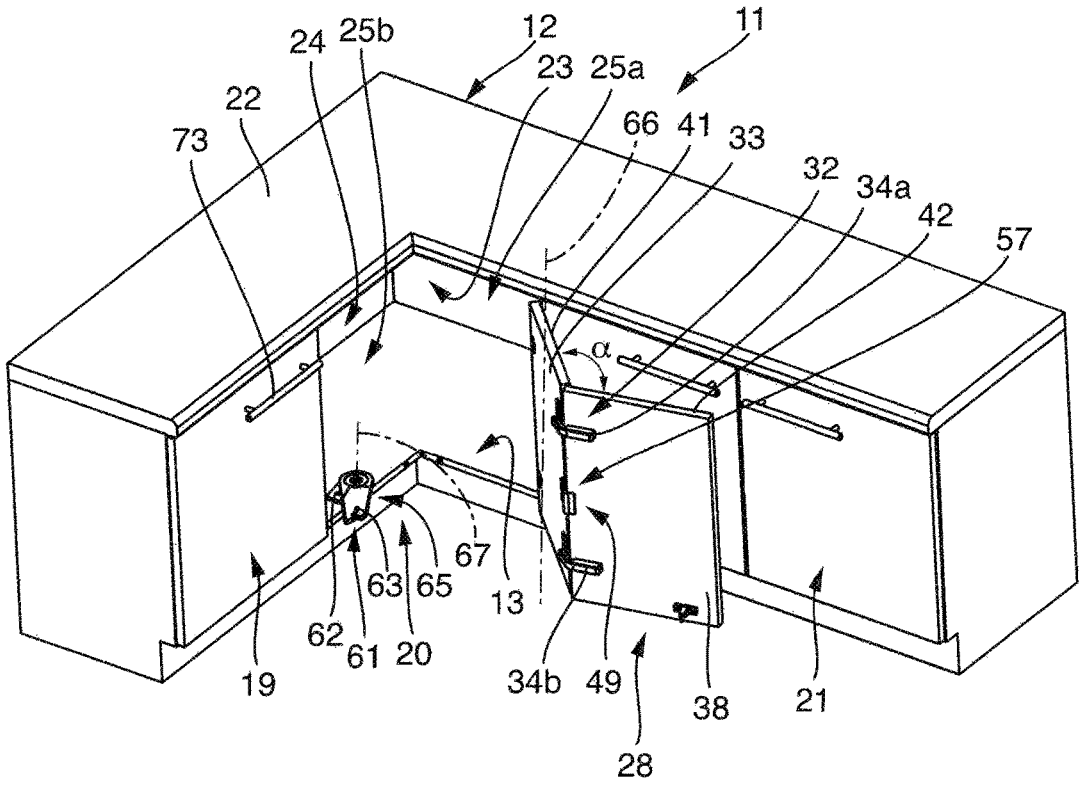
FIG. 2 shows a perspective representation of the corner cabinet from FIG. 1 with open corner cabinet door.
Figure 3:
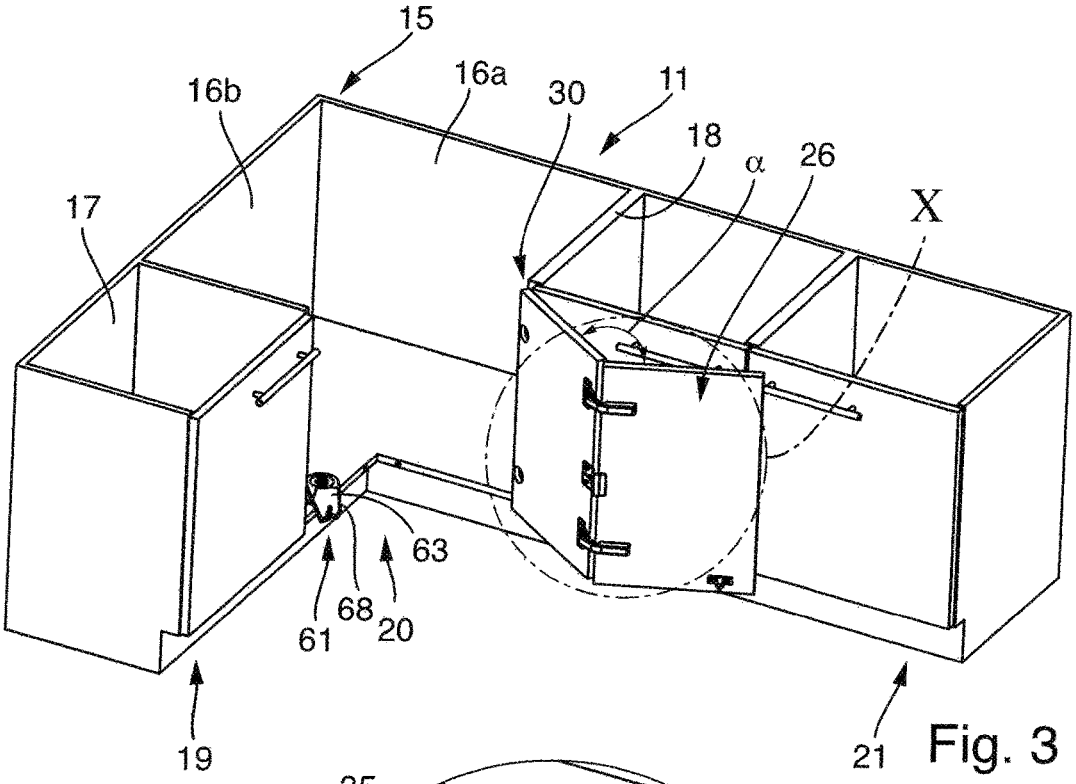
FIG. 3 shows a perspective representation of the corner cabinet from FIG. 2 without upper cabinet covering.

As in particular illustrated in FIG. 2, in relation to the inner carcass component 20, the L-shaped cabinet base 13, the two side walls 17, 18, the two rear wall parts 16*a*, 16*b* and the L-shaped section of the work surface 22 delimit an interior space 23. As also shown in FIG. 2, the outer edges of the side walls 17, 18, the outer edges of the L-shaped cabinet base 13 and lower edges of the L-shaped section of the work surface 22 delimit a door opening 24 which in the example shown has two opening sections 25*a*, 25*b* arranged at right angles relative to one another.

The inner carcass component 20 is also associated with a corner cabinet door 26 mounted on the cabinet carcass 12 so as to swivel between a closed position 27 in which the door opening 24 is closed (FIG. 1) and an open position 28 which allows access to the interior space 23 of the cabinet carcass 12 (FIG. 2).

The corner cabinet door 26 is designed as a folding door, with a first door element 29 which is mounted on the cabinet carcass 12 in the vicinity of the door opening 24 by means of a door bearing device 30 and with a second door element 31 which is mounted swivelably on the first door element 29 via swivel bearing means 32. The door bearing device 30 by means of which the first door element 29 is swivelably mounted is located in the region of the right-hand opening section 25*a* and in the region of the right-hand side wall 18. The door bearing device 30 comprises two hinges (not shown) which are fixed, on the one hand, to the side of the side wall 18 facing the interior space 23 and on the other hand to the inner side 33 of the first door element 29.

Figure 4:
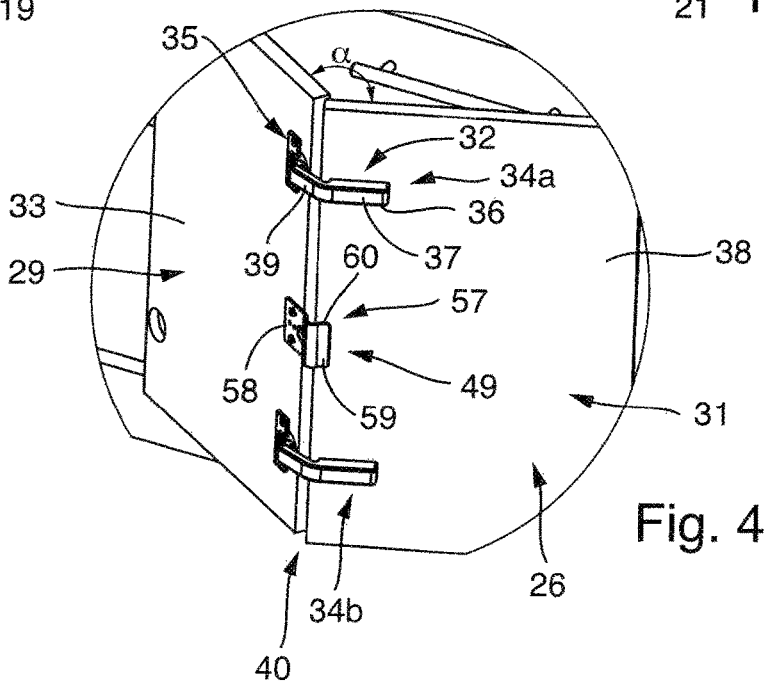
FIG. 4 shows an enlarged representation of the detail X from FIG. 3.
Figure 8:
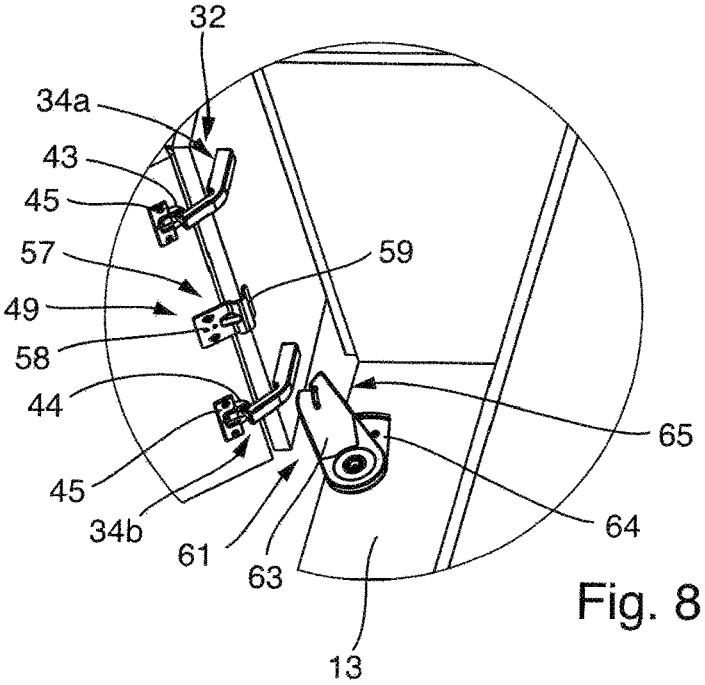
FIG. 8 shows an enlarged representation of the detail Y from FIG. 7.
Figure 9:
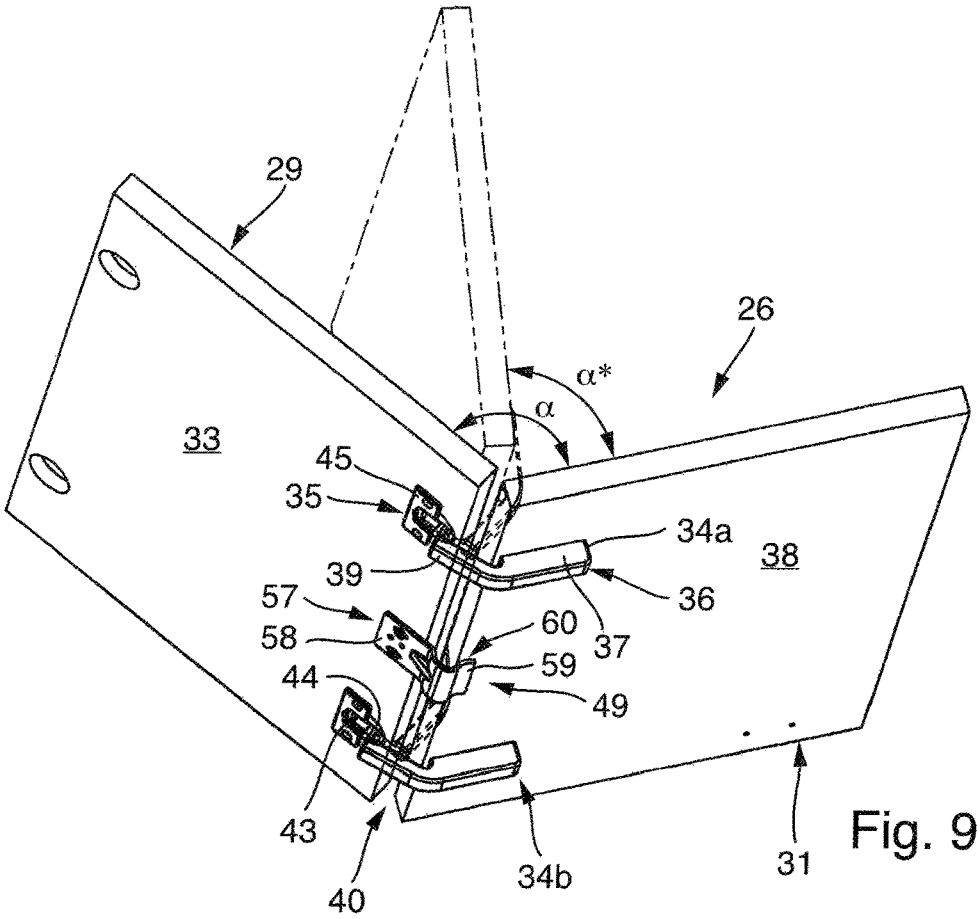
FIG. 9 shows a perspective representation of a first exemplary embodiment of the corner cabinet with a first embodiment of the swivel angle limiting device, with an alternative position of the second door element indicated by a broken line.
Figure 10:
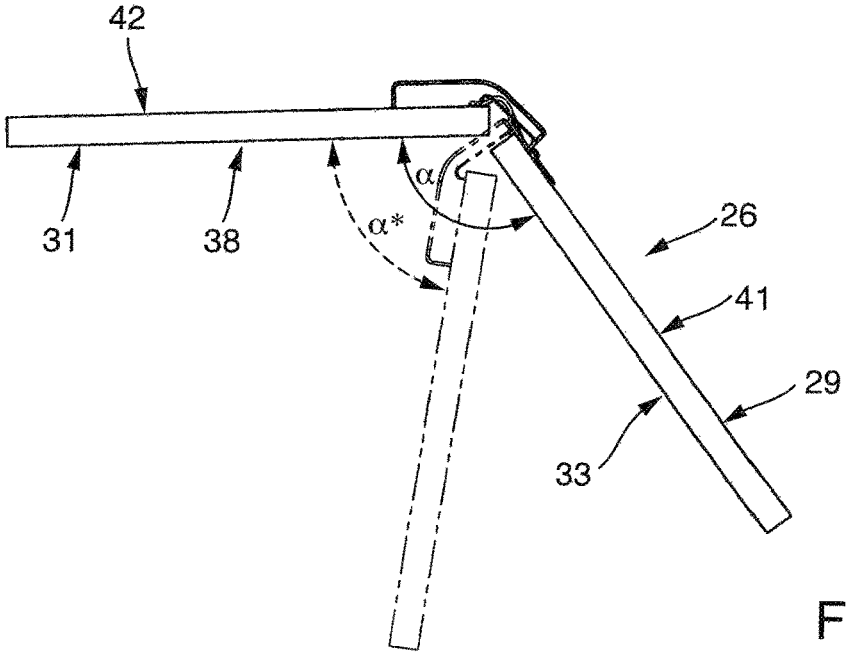
FIG. 10 shows a top view of the corner cabinet door from FIG. 9.

The second door element 31 is, as mentioned, mounted swivelably on the first door element 29 via the swivel bearing means 32. In the example shown, as shown in FIGS. 4, 8 and 9 in particular, the swivel bearing means 32 comprise at least one hinge 34 connecting the two door elements 29, 31 swivelably with one another, in particular two hinges 34*a*, 34*b*, of which a first hinge 34*a* is arranged in the upper region of the two door elements 29, 31 and a second hinge 34*b* is arranged in the lower region of the two door elements 29, 31. The hinges 34*a*, 34*b* each possess a first hinge part 35 fixed on the first door element 29 and a second hinge part 36 fixed on the second door element 31 which are connected with one another in an articulated manner via at least one articulated joint. In the example shown, the two hinge parts 35, 36 are designed in the form of a hinge cup and a hinge arm, wherein, as shown in FIG. 4 in particular, according to a first exemplary embodiment the hinge cup is fixed to the first door element 29 and the hinge arm is fixed to the second door element 31.

As shown in FIG. 9 in particular, the hinge arm associated with the second door element 31 possesses a fixing section 37, which is fixed onto the inner side 38 of the second door element. Connected in a single piece with the fixing section 37, an arm section 39 is provided which bridges a joint 40 between the two door elements 29, 31 and points in the direction of the hinge cup. The arm section 39 projects at an angle from the associated fixing section 37 and is oriented at an angle in the direction of outer sides 41, 42 of the two door elements 29, 31.

As also shown in FIG. 9, the hinge cup possesses a cup section 43 which is fitted in a cup-like recess 44 in the inner side 38 of the first door element 29. In addition to the cup section 43 the hinge cup also possesses a mounting plate 45 for mounting on the inner side 33 of the first door element. The mounting plate 45 possesses for example two mounting holes via which fixing screws can be screwed into the material of the first door element 29.

The cup section 43 of the hinge cup possesses a cup opening 46 bounded by a cup wall 47 which is limited on the underside by a cup bottom. A lever 48 connecting a hinge cup and hinge arm with one another is also provided which on the one hand is mounted in an articulated manner on the hinge cup and on the other hand is mounted in an articulated manner on the hinge arm, in particular on its arm section 39. The cup-side mounting of the lever 48 can for example be located within the region of the cup wall 47. The lever 48 can for example have a bearing pin (not shown) which projects to the left and right of the lever 48 and is mounted rotatably in openings in opposite wall sections of the cup wall 47.

A swivel angle limiting device 49 acting between the two door elements 29, 31 is provided by means of which the swiveling range of the two door elements 29, 31 relative to one another is limited to a maximum external angle $\alpha$ which lies within the range from 45° to 180°.

In the example shown, the two opening sections 25*a*, 25*b* of the door opening 24 are oriented at an angle of 90° relative to one another. Therefore, in the closed position 27 the two door elements 29, 31 assume an external angle $\alpha$ which amounts to 90°.

The swivel angle limiting device 49 possesses a stop surface 50 formed on the first or second hinge part 35, 36, i.e. on the hinge arm or on the hinge cup, for a corresponding stop 51 formed for this purpose on the second and first hinge part 36, 35, i.e. the hinge arm or hinge cup, which on swiveling of the two door elements 29, 31 impinges on the associated stop surface 50.

Figure 11:
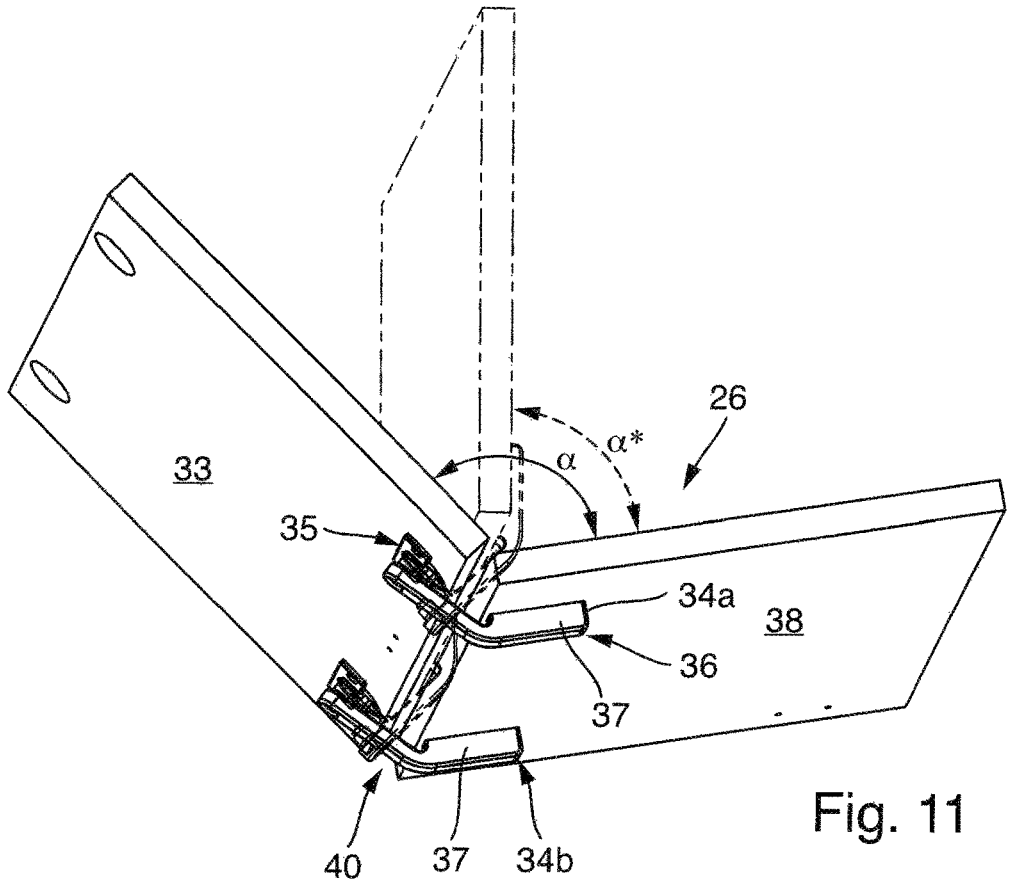
FIG. 11 shows a second embodiment of the swivel angle limiting device in a corner cabinet door of a second exemplary embodiment of the corner cabinet.
Figure 12:
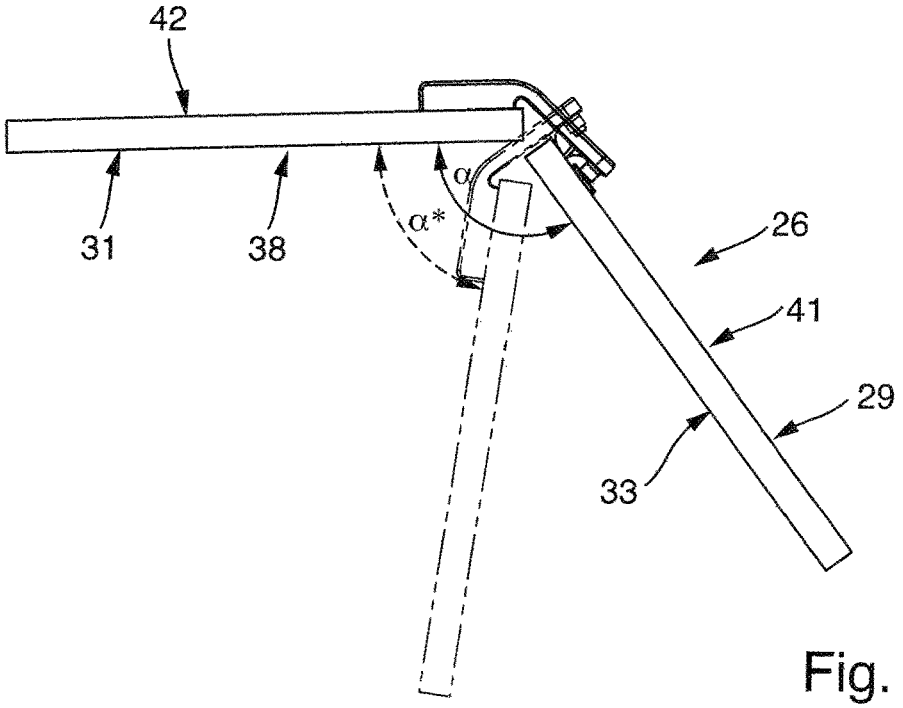
FIG. 12 shows a top view of the corner cabinet door from FIG. 11
Figure 13:
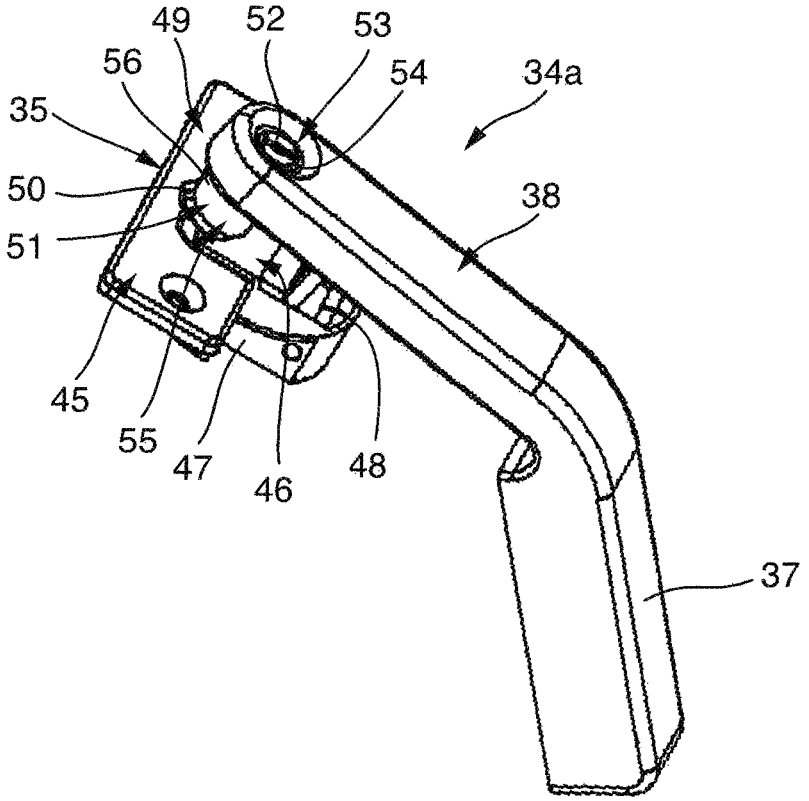
FIG. 13 shows a perspective representation of a component of the second embodiment of the swivel angle limiting device.

As shown in FIGS. 11 to 13 in particular, according to the second exemplary embodiment of the corner cabinet 11 according to the invention the stop surface 50 is arranged on the cup wall 47 of the hinge cup and, from the cup base, is oriented facing obliquely away from the hinge arm. In contrast, the stop 51 is formed by an adjustment screw 52 which is part of an adjustment device 53.

The adjustment screw 52 is arranged on the free end of the arm section 39 of the hinge arm. On the arm section 39 there is a threaded bore 54 with an inner thread which interacts with an outer thread formed on a screw shaft of the adjustment screw. As shown in FIG. 13 in particular, the greatest part of the adjustment screw 52 projects downwards from the threaded bore 54, this projecting part forming the stop 51. The screw head of the adjustment screw 52 is equipped with an engagement structure for engagement of an operating tool, in particular a screwdriver. A cross-slot structure is illustrated by way of example.

As already mentioned, the part of the screw shaft 55 projecting downwards from the threaded bore 54 forms the adjustment screw 52 of the stop 51, wherein a surface section 56 of the screw shaft 55 can be brought into contact with the sloping stop surface 50 on the cup wall 47. The impingement of the stop 51, i.e. of the surface section 56, on the sloping stop surface 50 defines the maximum external angle α.

Since the depth of penetration of the adjustment screw 52 within the threaded bore 54 is variable, the maximum external angle α can be changed, wherein in the specific case unscrewing the adjustment screw from the threaded bore 54 produces an enlargement of the maximum external angle α. Conversely, the maximum external angle α can be reduced by screwing the adjustment screw 52 into the threaded bore 54.

FIGS. 1 to 10 show a first exemplary embodiment of the corner cabinet 11 according to the invention in which the swivel angle limiting device is not, as in the second exemplary embodiment described above, associated with the swivel bearing means, i.e. the hinges 34*a*, 34*b*, but is formed separately from the swivel bearing means, i.e. the hinges 34*a*, 34*b*.

According to a first exemplary embodiment, the swivel angle limiting device 49 comprises at least one angle piece 57 which has an in particular plate-like mounting section 58 by means of which the angle piece 57 is fixed to the inner side of the first door element 29.

As shown in FIG. 9 in particular, the angle piece also possesses a stop section 59 which is in particular formed in a single piece with the mounting section 58 and projects from this at an angle. The stop section 59 serves as a stop for the second door element and bridges the joint 40 between the two door elements 29, 31, wherein the free end terminates with a stop surface 60 within the region of the inner side 38 of the second door element 31.

As shown in FIG. 9 in particular, the angle piece 57 is located approximately in the centre between the two hinges 34*a*, 34*b*. The angle piece 57 is a relatively economical retrofit component, so that corner cabinet doors 26 equipped with conventional hinges can be retrofitted with a swivel angle limiting device 49.

The corner cabinet also comprises a control device 61 for controlling the movement of the corner cabinet door 26. The control device possesses a base part 62 fixed to the cabinet carcass 12 on the cabinet base 13 within the region of the left-hand second opening section 25*b* and a control part 63 which is mounted on the base part 62 so as to be moveable between an inner position 64 and an outer position 65 in which it projects beyond the plane of the door opening 24. In the example shown, the control part 63 is a control arm which is mounted on the base part 62 so as to be swivelable around an arm swivel axis 67 spaced at a distance from the door swivel axis 66.

The control part 63 can be coupled with the second door element 31 when closing and uncoupled when opening by means of coupling means, such that it controls the movement of the second door element 31 at the end of the closing phase and at the beginning of the opening phase. The control device 61 possesses locking means (not shown) by means of which the control part 63 is locked in position in its outer position 65 with uncoupled second door element, wherein the locking means are designed such that on coupling the second door element 31 and control part 63 a release of the locking takes place enabling swiveling of the control part 63.

The control part possesses on its outer side 68 a stop surface 69 for the second door element 31 which is active in the locked outer position 65.

As shown in FIG. 1 in particular, a door handle 70 is arranged on the outer side 42 of the second door element 31. The outer carcass components 19, 21 surrounding the inner carcass component 20 each possess a cabinet door 71 which is not designed in the form of a folding door, wherein door handles 73 are also arranged on the outer sides 72 of the cabinet doors 71.

The corner cabinet door 26 is initially in the closed position 27 illustrated in FIG. 1. The outer sides 41, 42 of the two door elements 29, 31 thereby enclose an external angle α which amounts to 90°. In order to open the corner cabinet door 26, the user grasps the door handle 70 formed on the second door element and pulls the second door element 31 in their direction. The whole corner cabinet door thereby swivels around the door swivel axis 66. At the beginning of the opening phase, the second door element 31 is controlled by the control device 61, as a result of which the control part 63 swings out of the plane of the door opening 24. After a certain opening travel, the control part 63 and second door element 31 are uncoupled. The corner cabinet door 26 can now be swivelled open further, wherein the external angle α assumed in the inner position is variable.

As shown in FIG. 2 in particular, the swivel angle limiting device 49 prevents the second door element 31 from being able to swivel around the first door element 29 within a large angular range. In the example shown, the maximum external angle is limited to approx. 125°. Thus, if the external angle α is increased when opening the door, this is only possible up to approx. 125°. Once this angle is reached, the inner side 38 of the second door element 31 impinges against the stop surface 60 on the stop section 59 of the angle piece 57. This situation is shown, by way of example, in FIG. 2.

When closing the corner cabinet door 26, the whole corner cabinet door 26 initially swivels inwards around the door swivel axis 66. As shown in FIG. 6 in particular, the inner side 38 of the second door element 31 then initially impinges against the stop surface 69 on the outer side 68 of the control part 63 of the control device 61. This prevents the inner side 38 of the second door element 31 from colliding with the door handle 73 of the cabinet door 71 of the carcass component 19 arranged to the left of the inner carcass component 20. This prevents damage to this door handle.

On further closing, the movement of the second door element 31 is controlled by means of the control part 63. Finally, the corner cabinet door 26*a* reaches the closed position 27, in which the control part 63 coupled to the second door element 31 is located in its inner position 64.

What is claimed is:

1. A corner cabinet comprising:

a cabinet carcass with a door opening; and a corner cabinet door which is mounted on the cabinet carcass so as to swivel between a closed position in which the door opening is closed and an open position allowing access to an interior space of the cabinet carcass, wherein the corner cabinet door is designed as a folding door, with a first door element which is mounted on the cabinet carcass in the vicinity of the door opening by means of a door bearing device, and with a second door element which is mounted swivelably on the first door element via swivel bearing means, the swivel bearing means comprising at least one hinge connecting the two door elements swivelably with one another, the at least one hinge having a first hinge part fixed on the first door element and a second hinge part fixed on the second door element, the first and second hinge parts being connected with one another in an articulated manner via at least one articulated joint, and wherein, in the closed position, outer sides of the two door elements pointing away from the interior space enclose an external angle α which, in the closed position, lies within the range from 45° to 180° and which can be changed when opening the corner cabinet door;

a swivel angle limiting device acting between the two door elements is provided through which the swiveling range of the two door elements relative to one another is limited to a maximum external angle α which lies within the range from 45° to 180°, wherein the swivel angle limiting device has a stop surface formed on the first or second hinge part for a corresponding stop formed on the other of the first or second hinge part which impinges on the associated stop surface on swiveling of the two door elements, wherein the stop forms part of an adjustment device and is in the form of an adjustment element formed adjustably on one of the two hinge parts, such that the adjustment element impinges on the stop surface during swiveling of the two door elements, depending on an adjustment position; wherein the two hinge parts are designed in the form of a hinge cup and a hinge arm, wherein the hinge cup is attached to the first door element and the hinge arm is attached to the second door element; and wherein the hinge cup has a cup section which is fitted in a cup-shaped recess in an inner side of the first door element, and wherein the cup section has a cup opening bounded by a cup wall on which the stop surface for the stop is formed.

2. The corner cabinet according to claim 1, wherein the hinge arm has a fixing section attached to an inner side of the second door element and an arm section bridging a joint between the two door elements and pointing in the direction of the hinge cup which projects at an angle from the fixing section in the direction of the outer surfaces of the door elements, wherein the stop is arranged on a free end of the arm section.

3. A corner cabinet comprising:

a cabinet carcass with a door opening; and a corner cabinet door which is mounted on the cabinet carcass so as to swivel between a closed position in which the door opening is closed and an open position allowing access to an interior space of the cabinet carcass, wherein the corner cabinet door is designed as a folding door, with a first door element which is mounted on the cabinet carcass in the vicinity of the door opening by means of a door bearing device, and with a second door element which is mounted swivelably on the first door element via swivel bearing means, and wherein, in the closed position, outer sides of the two door elements pointing away from the interior space enclose an external angle α which, in the closed position, lies within the range from 45° to 180° and which can be changed when opening the corner cabinet door;

a swivel angle limiting device acting between the two door elements is provided through which the swiveling range of the two door elements relative to one another is limited to a maximum external angle α which lies within the range from 45° to 180°; and a control device for controlling the movement of the corner cabinet door, the control device having a base part fixed onto the cabinet carcass and a control part mounted swivelably on the base part so as to be moveable between an inner position and an outer position in which the control part projects beyond the plane of the door opening, wherein the control part can be coupled with the second door element when closing and uncoupled when opening by means of coupling means, such that the control part controls the movement of the second door element at the end of a closing phase and at the beginning of an opening phase.

* * * * *